US005133924A

United States Patent [19]

Appel et al.

[11] Patent Number: 5,133,924

[45] Date of Patent: Jul. 28, 1992

[54] PROCESS FOR PREPARING A HIGH BULK DENSITY GRANULAR DETERGENT COMPOSITION

[75] Inventors: Peter W. Appel, Rotterdam; Petrus L. J. Swinkels, Vlaardingen; Marco Waas, Rotterdam, all of Netherlands

[73] Assignee: Lever Brothers Company, New York, N.Y.

[21] Appl. No.: 430,838

[22] Filed: Nov. 2, 1989

[30] Foreign Application Priority Data

Nov. 2, 1988 [GB] United Kingdom ..... 8825659
Dec. 16, 1988 [GB] United Kingdom ..... 8829346

[51] Int. Cl.[5] ..... C11D 17/06

[52] U.S. Cl. ..... 264/342 R; 252/89.1; 252/174; 264/117

[58] Field of Search ..... 264/117, 342 R; 252/89.1, 174

[56] References Cited

U.S. PATENT DOCUMENTS

| | | | |
|---|---|---|---|
| 3,304,355 | 2/1967 | Pobst, Jr. et al. | 264/117 |
| 4,372,868 | 2/1983 | Saran et al. | 252/102 |
| 4,587,031 | 5/1986 | Kruse et al. | 252/135 |
| 4,726,908 | 2/1988 | Kruse et al. | 252/91 |
| 4,828,721 | 5/1989 | Bollier et al. | 252/8.7 |
| 4,846,409 | 7/1989 | Kaspar et al. | 241/21 |
| 4,869,843 | 9/1989 | Saito et al. | 252/135 |
| 4,923,628 | 5/1990 | Appel et al. | 252/135 |
| 4,925,585 | 5/1990 | Strauss et al. | 252/89.1 |

FOREIGN PATENT DOCUMENTS

| | | |
|---|---|---|
| 219328 | 4/1987 | European Pat. Off. . |
| 220024 | 4/1987 | European Pat. Off. . |
| 229671 | 7/1987 | European Pat. Off. . |
| 0339996 | 11/1989 | European Pat. Off. . |
| 61-6989 | 4/1986 | Japan . |
| 1453697 | 10/1976 | United Kingdom . |
| 1517713 | 7/1978 | United Kingdom . |

OTHER PUBLICATIONS

Seifen Ole Fette Wachse—Translation.

*Primary Examiner*—Mary Lynn Theisen
*Attorney, Agent, or Firm*—James J. Farrell

[57] ABSTRACT

A granular detergent composition or component having a bulk density of at least 650 g/l can be prepared by treating a particulate starting material (i) in a first step in a high-speed mixer/densifier, the mean residence time being from about 5–30 seconds;

(ii) in a second step in a moderate-speed granulator/-densifier, whereby it is brought into, or maintained in, a deformable state, the mean residence time being from about 1–10 minutes and (iii) in a final step in drying and/or cooling apparatus.

Preferably, the deformable state is induced in the first step.

8 Claims, No Drawings

PROCESS FOR PREPARING A HIGH BULK DENSITY GRANULAR DETERGENT COMPOSITION

TECHNICAL FIELD

The present invention relates to a process for the preparation of a granular detergent composition having a high bulk density and good powder properties. More in particular, it relates to a process for the continuous preparation of such detergent compositions. Moreover, it relates to a granular detergent composition obtainable by the process of the present invention.

BACKGROUND AND PRIOR ART

Recently there has been considerable interest within the detergents industry in the production of detergent powders having relatively high bulk density, for example 600 g/liter and above.

Generally speaking, there are two main types of processes by which detergent powders can be prepared. The first type of process involves spray-drying an aqueous detergent slurry in a spray-drying tower. In the second type of process the various components are dry-mixed and optionally agglomerated with liquids, e.g. nonionics.

The most important factor which governs the bulk density of a detergent powder is the bulk density of the starting materials in the case of a dry-mixing process, or the chemical composition of the slurry in the case of a spray-drying process. Both factors can only be varied within a limited range. For example, one can increase the bulk density of a dry-mixed powder by increasing its content of the relatively dense sodium sulphate, but the latter does not contribute to the detergency of the powder, so that its overall properties as a washing powder will generally be adversely affected.

Therefore, a substantial bulk density increase can only be achieved by additional processing steps which lead to a densification of the detergent powders. There are several processes known in the art leading to such densification. Particular attention has thereby been paid to the densification of spray-dried powders by post-tower treatment.

The European patent application 219,328 (UNILEVER) discloses a granular low-phosphate detergent composition prepared by spray-drying a slurry to give a base powder containing a low to moderate level of sodium tripoly-phosphate builder and low levels of inorganic salts, and then post-dosing solid material including sodium sulphate of high bulk density and of smaller particle size than the base powder, thus filling the voids between the base powder particles and producing a product of high bulk density.

The Japanese patent application 61 069897 (KAO) discloses a process in which a spray-dried detergent powder containing a high level of anionic surfactant and a low level of builder (zeolite) is subjected successively to pulverizing and granulating treatments in a high-speed mixer/granulator, the granulation being carried out in the presence of an "agent for improving surface properties" and optionally a binder. It would appear that in the high-speed mixer/granulator, the spray-dried powder is initially broken down to a fine state of division; the surface-improving agent and optional binder are then added and the pulverized material granulated to form a final product of high bulk density. The surface-improving agent, which is a finely divided particulate solid such as fine sodium aluminosilicate, is apparently required in order to prevent the composition from being formed into large balls or cakes.

The process described in this Japanese patent application is essentially a batch process and is therefore less suitable for the large scale production of detergent powders.

The European patent application 229,671 (KAO) discloses post-dosing a crystalline alkaline inorganic salt, for example sodium carbonate, to a spray-dried base powder prepared as in the above-mentioned Japanese application 61 069897 (KAO) and containing a restricted level of water-soluble crystalline inorganic salts, to produce a high bulk density product.

The British patent application 1,517,713 (UNILEVER) discloses a batch process in which spray-dried or granulated detergent powders containing sodium tripolyphosphate and sodium sulphate are densified and spheronized in a "marumerizer" (Trade Mark). This apparatus comprises a substantially horizontal, roughened, rotatable table positioned within, and at the base of, a substantially vertical, smooth-walled cylinder.

The British patent application 1,453,697 (UNILEVER) discloses the use of a "marumarizer" (Trade Mark) for granulating together detergent powder components in the presence of a liquid binder to form a granular detergent composition.

The disadvantage associated with this apparatus is that it produces powders or granules having a rather wide particle size distribution, and in particular containing a relatively high proportion of oversize particles. Such products exhibit poor dissolution and dispersion characteristics, particularly in low-temperature short duration machine washes as used in Japanese and other far-eastern washing machines. This can be apparent to the consumer as deposits on washed fabrics, and in machine washing leads to a high level of wastage.

The European patent application 220,024 (Procter & Gamble) discloses a process in which a spray-dried detergent powder containing a high level (30–85% by weight) of anionic surfactant is mixed with an inorganic builder (sodium tripolyphosphate, or sodium aluminosilicate and sodium carbonate) and compacted under high pressure using a roll compactor ("chilsonator"); the compacted material, after removal of oversize material and fines, is then granulated using conventional apparatus, for example a fluidized bed, tumble mixer, or rotating drum or pan.

In an article in Seifen-Öle-Fette-Wachse (114, 8, pages 315–316 (1988)), B. Ziolkowsky describes a process for obtaining a detergent powder having an increased bulk density by treating a spray-dried detergent composition in two-step post-tower process, which can be carried out in a Patterson-Kelly Zig-Zag® agglomeration apparatus. In the first part of this machine, the spray-dried powder is fed into a rotating drum, in which a liquid-dispersing wheel equipped with cutting blades is rotating. In this first processing step a liquid is sprayed on to the powder and is thoroughly admixed therewith. By the action of the cutters, the powder is pulverized and the liquid causes agglomeration of the pulverized powder to form particles having an increased bulk density compared to that of the starting material.

The bulk density increase obtained is dependent on a number of factors, such as the residence time in the drum, its rotational speed and the number of cutting blades. After a short residence time, a light product is obtained, and after a long residence time a denser product.

In the second part of the machine, which is essentially a rotating V-shaped tube, the final agglomeration and conditioning of the powder take place. After the densification process, the detergent powder is cooled and/or dried.

Although it is possible by means of one or more of the above-mentioned processes to prepare detergent powders having a high bulk density, each of these routes has its specific disadvantages. It is therefore an object of the present invention to provide an improved continuous process for obtaining high bulk density granular detergent compositions or components thereof, having a bulk density of at least 650 g/l. The process should be especially suitable for the large scale manufacture of such compositions.

We have now found that the above and other objects can be achieved by the process of the present invention. According to the invention, it was found that a substantial increase of the bulk density of a detergent powder can only be obtained if the particle porosity, which may be in the order of 20–70% for a spray-dried base powder, is successfully reduced to, or kept at, values of less than 10%, preferably less than 5%. This can be achieved by carrying out the detergent powder manufacturing process under conditions wherein a particulate starting material is brought into or maintained in a deformable state.

DEFINITION OF THE INVENTION

In a first aspect, the present invention provides a process for the continuous preparation of a granular detergent composition or component having a bulk density of at least 650 g/l, which comprises treating a particulate starting material (i) in a first step in a high-speed mixer/densifier, the mean residence time being from about 5–30 seconds;

(ii) in a second step in a moderate-speed granulator/densifier, whereby it is brought into, or maintained in, a deformable state, the mean residence time being from about 1–10 minutes and (iii) in a final step in drying and/or cooling apparatus.

Preferably, the particulate starting material is already brought into, or maintained in, a deformable state in the first step.

In a second aspect, the present invention provides a granular detergent composition obtainable by the process of the invention, said composition having a particle porosity of less than 10%, preferably less than 5%.

DETAILED DESCRIPTION OF THE INVENTION

In the process of the present invention, a particulate starting material is treated in a two-step densification process to increase its bulk density to values of at least 650 kg/l.

The particulate starting material may be prepared by any suitable method, such as spray-drying or dry-mixing. It comprises compounds usually found in detergent compositions such as detergent active materials (surfactants) and builders.

The detergent active material may be selected from anionic, ampholytic, zwitterionic or nonionic detergent active materials or mixtures thereof. Particularly preferred are mixtures of anionic with nonionic detergent active materials such as a mixture of an alkali metal salt of alkyl benzene sulphonate together with an alkoxylated alcohol.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols, produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; and sodium alkyl glyceryl ether sulphates, especially those ethers of the higher alcohols derived from tallow or coconut oil and synthetic alcohols derived from petroleum. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, i.e. 5 to 25 units of ethylene oxide per molecule, and the condensation products of aliphatic ($C_8$–$C_{18}$) primary or secondary linear or branched alcohols with ethylene oxide, generally 5 to 40 EO.

Mixtures of detergent compounds, for example, mixed anionic or mixed anionic and nonionic compounds, may be used in the detergent compositions, particularly in the latter case to provide controlled low sudsing properties. This is beneficial for compositions intended for use in suds-intolerant automatic washing machines.

Amounts of amphoteric or zwitterionic detergent compounds can also be used in the compositions of the invention but this is not normally desired owing to their relatively high cost.

The detergency builder may be any material capable of reducing the level of free calcium ions in the wash liquor and will preferably provide the composition with other beneficial properties such as the generation of an alkaline pH, the suspension of soil removed from the fabric and the suspension of the fabric-softening clay material. The level of the detergency builder may be from 10% to 70% by weight, most preferably from 25% to 50% by weight.

Examples of detergency builders include precipitating builders such as the alkali metal carbonates, bicarbonates, orthophosphates, sequestering builders such as the alkali metal tripolyphosphates or nitrilotriacetates, or ion exchange builders such as the amorphous alkali metal aluminosilicates or the zeolites.

The process is therefore very flexible with respect to the chemical composition of the starting material. Phosphate-containing as well as zeolite-containing compositions, and compositions having either a low or a high active content may be used. The process is also suitable for densifying calcite/carbonate-containing detergent compositions.

It was found to be essential for obtaining an optimal densification to subject the particulate starting material to a two-step densification process. The first step is carried out in a high-speed mixer/densifier, preferably under conditions whereby the starting material is brought into, or maintained in, a deformable state, to be defined hereafter. As a high-speed mixer/densifier we advantageously used the Lödige (Trade Mark) CB 30 recycler. This apparatus essentially consists of a large static hollow cylinder and a rotating shaft in the middle. The shaft has several different types of blades mounted thereon. It can be rotated at speeds between 100 and 2500 rpm, dependent on the degree of densification and the particle size desired. The blades on the shaft provide a thorough mixing action of the solids and the liquids which may be admixed in this stage. The mean residence time is somewhat dependent on the rotational speed of the shaft, the position of the blades and the weir at the exit opening. It is also possible to add solid material in the Lödige recycler.

Other types of high-speed mixers/densifiers having a comparable effect on detergent powders can also be contemplated. For instance, a Shugi (Trade Mark) Granulator or a Drais (Trade Mark) K-TTP 80 could be used.

In order to obtain densification of the detergent starting material, it proved to be advantageous that the starting material is brought into, or maintained in, a deformable state, to be defined hereafter. The high-speed mixer/granulator is then able to effectively deform the particulate material in such a way that the particle porosity is considerably reduced, or kept at a low level, and consequently the bulk density is increased.

If a dry-mixed powder is used as the particulate starting material, it generally already has a low particle porosity, so its bulk density can, in general, hardly be increased by reducing the particle porosity. However, the processing techniques known in the art commonly provide a processing step wherein additional components, such as nonionics, are added to the dry-mixed starting material, and thereby the particle porosity is usually increased owing to the formation of porous agglomerates. The process of the present invention is therefore also beneficial in such cases.

If a spray-dried powder is used as the particulate starting material, the particle porosity is considerable and a large increase in bulk density can be obtained by the process of this invention.

In the first step of the process according to the invention, the particulate starting material is thoroughly mixed in a high-speed mixer/densifier for a relatively short time of about 5–30 seconds.

Instead of selecting a longer residence time in the high-speed mixer to obtain a further bulk density increase, the process of the present invention provides a second processing step in which the detergent material is treated for 1–10 minutes, preferably for 2–5 minutes, in a moderate-speed mixer/densifier. During this second processing step, the conditions are such that the powder is brought into, or maintained in, a deformable state. As a consequence, the particle porosity will be further reduced. The main differences with the first step reside in the lower mixing speed and the longer residence time of 1–10 minutes.

The second processing step can be successfully carried out in a Lödige (Trade Mark) KM 300 mixer, also referred to as Lödige Ploughshare. This apparatus essentially consists of a horizontal, hollow static cylinder having a rotating shaft in the middle. On this shaft various plough-shaped blades are mounted. It can be rotated at a speed of 40–160 rpm. Optionally, one or more high-speed cutters can be used to prevent excessive agglomeration. Another suitable machine for this step is, for example, the Drais (Trade Mark) K-T 160.

Essential for the second step and preferred for the first step is the deformable state into which the detergent powder must be brought in order to get optimal densification. This deformable state may be induced in a number of ways, for instance by operating at temperatures above 45° C. When liquids such as water or nonionics are added to the particulate starting material, lower temperatures may be employed, for example 35° C. and above.

According to a preferred embodiment of the present invention, a spray-dried base powder leaving the tower at a temperature of above 45° C. is fed directly into the process of the present invention.

Alternatively, the spray-dried powder may be cooled first, e.g. in an airlift, and subsequently be heated again after transportation. The heat may be applied externally, possibly supplemented by internally generated heat, such as heat of hydration of water-free sodium tripolyphosphate.

The deformability of a detergent powder can be derived from its compression modulus, which in turn can be derived from its stress-strain characteristics. To determine the compression modulus of a specific composition and moisture content, a sample of the composition is compressed to form an airless prill of 13 mm diameter and height. Using an Instron testing machine, the stress-strain diagram during unconfined compression is recorded at a constant strain rate of 10 mm/min. The compression modulus can now be derived from the slope of the stress—versus relative strain diagram during the first part of the compression process, which reflects the elastic deformation. The compression modulus is expressed in MPa. In order to measure the compression modulus at various temperatures, the Instron apparatus can be equipped with a heatable sample holder.

The compression modulus as measured according to the above method was found to correlate well with the particle porosity decrease and the accompanying bulk density increase, under comparable processing conditions. This is further illustrated in the Examples.

As a general rule, the powder can be considered in a deformable state if the compression modulus as defined above is less than approximately 25, preferably less than 20 MPa. Even more preferably, the compression modulus is less than 15 MPa and values of less than 10 MPa are particularly preferred.

The particle porosity can be measured by Hg-porosimetry and the moisture content was determined by the weight loss of a sample at 135° C. after 4 hours.

The deformability of a powder depends, among other things, on the chemical composition, the temperature and the moisture content. As to the chemical composition, the liquids to solids ratio and the amount of polymer proved to be important factors. Moreover, it was generally more difficult to bring phosphate-containing powders into a deformable state than it was for zeolite-containing powders.

For use, handling and storage, the detergent powder must obviously no longer be in a deformable state. Therefore, in a final processing step according to the present invention, the densified powder is dried and/or cooled. This step can be carried out in a known way, for instance in a fluid bed apparatus (drying) or in an airlift (cooling). From a processing point of view, it is advantageous if the powder needs a cooling step only, because the required equipment is relatively simple.

The invention is further illustrated by the following non-limiting Examples, in which parts and percentages are by weight unless otherwise stated.

In the Examples which follow, the following abbreviations are used:

ABS: Alkyl benzene sulphonate

NI: Nonionic surfactant (ethoxylated alcohol), Synperonic A3 or A7 (3 or 7 EO groups, respectively) ex ICI STP: Sodium tripolyphosphate Carbonate: Sodium carbonate Sulphate: Sodium sulphate Silicate: Sodium alkaline silicate Zeolite: Zeolite 4A (Wessalith [Trade Mark] ex Degussa)

Polymer: Copolymer of maleic and acrylic acid having a molecular weight of 70,000, CP5 ex BASF

EXAMPLES 1-5

The following sodium tripolyphosphate-containing detergent powders were prepared by spray-drying aqueous slurries. The compositions of the spray-dried powders obtained (weight %) are shown in Table 1.

TABLE 1

| | Examples | | | | |
|---|---|---|---|---|---|
| | 1 | 2 | 3 | 4 | 5 |
| ABS | 16.5 | 12.9 | 13.2 | 13.2 | 13.2 |
| NI.7EO | 2.7 | 2.15 | 2.65 | 2.65 | 2.65 |
| STP | 45.5 | 53.65 | 50.2 | 50.2 | 50.2 |
| Carbonate | 6.9 | 4.3 | 0 | 0 | 0 |
| Polymer | 0.7 | 2.15 | 3.95 | 3.95 | 3.95 |
| Silicate | 6.2 | 9.7 | 10.6 | 10.6 | 10.6 |
| Minors | 1.0 | 2.05 | 1.3 | 1.3 | 1.3 |
| Water | 20.5 | 13.1 | 18.1 | 18.1 | 18.1 |

The powders were produced at a rate between 700 and 900 kg/h and had a temperature at tower base of about 60° C. The physical properties of the spray-dried powders are given in Table 2.

TABLE 2

| | Examples | | | | |
|---|---|---|---|---|---|
| | 1 | 2 | 3 | 4 | 5 |
| Bulk density [kg/m$^3$] | 410 | 417 | 428 | 428 | 428 |
| Particle porosity [%] | 47 | 51 | 45 | 45 | 45 |
| Moisture content [%] | 20.5 | 13.1 | 18.1 | 18.1 | 18.1 |
| Particle size [μm] | 498 | 537 | 632 | 632 | 632 |

The powders of Examples 2-5 were fed directly into a Lödige (Trade Mark) Recycler CB30, a continuous high-speed mixer/densifier, which was described above in more detail. The rotational speed was in all cases 1600 rpm. The powder of Example 1 was fed into the Recycler after passing through an airlift whereby the temperature of the powder was reduced to approximately 30° C. The mean residence time of the powder in the Lödige Recycler was approximately 10 seconds. In this apparatus also various solids and/or liquids, such as water, were added. Processing conditions and properties of the powder after leaving the Lödige Recycler are given in Table 3.

TABLE 3

| | Examples | | | | |
|---|---|---|---|---|---|
| | 1 | 2 | 3 | 4 | 5 |
| Powder temperature (°C.) | 30 | 58 | 55 | 55 | 55 |
| Addition of: | | | | | |
| Sulphate | 11.5 | 0 | 0 | 0 | 0 |
| STP | 25.7 | 0 | 0 | 0 | 0 |
| Carbonate | 0 | 6.45 | 0 | 0 | 0 |
| NI | 4.4 | 15.05 | 11.9 | 11.9 | 11.9 |
| Water | 5.8 | 15.05 | 6.6 | 3.3 | 1.85 |
| Bulk density [kg/m$^3$] | 591 | 699 | 656 | 656 | 671 |
| Particle porosity [%] | 32 | 23 | 21 | 26 | 27 |
| Moisture content [%] | 17.0 | 20.6 | 20.8 | 18.6 | 17.5 |
| Particle size [μm] | 357 | 606 | 501 | 385 | 374 |
| Modulus [MPa] | | | | | |
| at 60° C. | — | 5 | 5 | 12 | 17 |
| at 30° C. | 50 | — | — | — | — |

In all cases, the bulk density of the powders was significantly improved. The least results were obtained for the powder of Example 1, for which the values of the compression modulus indicate that it was not in a deformable state.

After leaving the Lödige Recycler, the powder was fed into a Lödige (Trade Mark) KM 300 "Ploughshare" mixer, a continuous moderate speed granulator/densifier described above in more detail. The rotational speed was 120 rpm and the cutters were used. The mean residence time of the powder in this piece of equipment was about 3 minutes. The processing conditions and properties of the powder after leaving the Lödige Ploughshare mixer are given in Table 4.

TABLE 4

| | Examples | | | | | |
|---|---|---|---|---|---|---|
| | 1a | 1b | 2 | 3 | 4 | 5 |
| Bulk density [kg/m$^3$] | 679 | 954 | 880 | 823 | 755 | 712 |
| Particle porosity [%] | 30 | 2 | 6 | 9 | 19 | 26 |
| Moisture content [%] | 16.5 | 16.7 | 20.6 | 20.8 | 18.6 | 17.5 |
| Particle size [μm] | 297 | 514 | 1061 | 489 | 357 | 354 |
| Temperature [°C.] | 32 | 48 | 50 | 45 | 45 | 45 |

Example 1 was carried out in two versions. In Example 1a the operating temperature in the Ploughshare was 32° C. and in Example 1b it was raised by external heating to 48° C. in order to make the powder deformable. The effect on the bulk density is evident. After leaving the moderate speed granulator/densifier, the bulk density of the powder was very high. In order to obtain the final powder, a drying step was needed. The drying step was carried out in an Anhydro (Trade Mark) fluid bed. Afterwards, the particles (larger than 1900 μm) were removed by leading the powder through a sieve of 10 Mesh. The resulting properties of the powder after the final step are given in Table 5.

TABLE 5

| | Examples | | | | | |
|---|---|---|---|---|---|---|
| | 1a | 1b | 2 | 3 | 4 | 5 |
| Bulk density [kg/m$^3$] | 664 | 907 | 900 | 842 | 778 | 720 |
| Dynamic | 53 | 92 | 144 | 107 | 98 | 84 |

TABLE 5-continued

| | Examples | | | | | |
|---|---|---|---|---|---|---|
| | 1a | 1b | 2 | 3 | 4 | 5 |
| flow rate [ml/s] | | | | | | |
| Particle porosity [%] | 32 | 2 | 7 | 9 | 18 | 26 |
| Moisture content [%] | 13.0 | 13.2 | 17.3 | 19.5 | 18.2 | 17.5 |
| Particle size [μm] | 284 | 514 | 1014 | 455 | 352 | 357 |

The obtained powders were supplemented with TAED/perborate bleach particles, antifoam granules, and enzymes to formulate fabric washing powders which all had to a good wash performance.

EXAMPLES 6–8

The following zeolite-containing detergent powders were prepared by spray-drying aqueous slurries. The compositions of the powders thus obtained are shown in Table 6 (weight %).

TABLE 6

| | Examples | | |
|---|---|---|---|
| | 6 | 7 | 8 |
| ABS | 19.3 | 12.85 | 15.1 |
| NI | 2.15 | 5.5 | 6.55 |
| Zeolite | 51.6 | 52.1 | 49.1 |
| Carbonate | 4.3 | 5.0 | 4.9 |
| Polymer | 8.6 | 8.35 | 8.2 |
| Minors | 1.85 | 2.6 | 2.55 |
| Water | 12.2 | 13.6 | 13.6 |

The powders were produced at a rate beween 700 and 900 kg/h and had a temperature at tower base of about 60° C.

The physical properties of the spray-dried powders are given in Table 7.

TABLE 7

| | Examples | | |
|---|---|---|---|
| | 6 | 7 | 8 |
| Bulk density [kg/m$^3$] | 458 | 516 | 544 |
| Particle porosity [%] | 38 | 33 | 30 |
| Moisture content [%] | 12.2 | 13.6 | 13.6 |
| Particle size [μm] | 613 | 581 | 580 |

The powders were fed directly into a Lödige (Trade Mark) Recycler CB30, a continuous high speed mixer/densifier, which was described above in more detail. The rotational speed was in all cases 1600 rpm. The mean residence time of the powder in the Lödige Recycler was approximately 10 seconds. In this apparatus, various solids and/or liquids were added as indicate in Table 8. The effect of the addition of water was studied by carrying out Examples 6 and 7 with and without water. Processing conditions and properties of the powder after leaving the Lödige Recycler are given in Table 8.

TABLE 8

| | Examples | | | | |
|---|---|---|---|---|---|
| | 6a | 6b | 7a | 7b | 8 |
| Powder temperature (°C.) | 60 | 60 | 60 | 60 | 60 |
| addition of: | | | | | |
| Carbonate | 0 | 0 | 11.7 | 11.7 | 9.85 |

TABLE 8-continued

| | Examples | | | | |
|---|---|---|---|---|---|
| | 6a | 6b | 7a | 7b | 8 |
| NI | 6.45 | 6.45 | 9.35 | 9.35 | 11.15 |
| Water | 0 | 3.2 | 0 | 3.35 | 0 |
| Bulk density [kg/m$^3$] | 685 | 738 | 717 | 729 | 740 |
| Particle porosity [%] | 25 | 20 | 23 | 22 | 18 |
| Moisture content [%] | 11.5 | 14.0 | 11.2 | 13.6 | 11.2 |
| Particle size [μm] | 403 | 728 | 459 | 572 | 489 |
| Modulus [MPa] at 60° C. | 14 | 3 | 19 | 4 | 1.5 |

It is evident that the addition of water in the Recycler significantly reduces the compression modulus, which leads to a drastic increase in bulk density. After leaving the Lödige Recycler, the powder was fed into a Lödige (Trade Mark) KM 330 "Ploughshare" mixer, a continuous moderate-speed granulator/densifier, operated at 120 rpm and the cutters on. The mean residence time of the powder in this apparatus was about 3 minutes. The processing conditions and properties of the powder after leaving the Lödige Ploughshare mixer are given in Table 9.

TABLE 9

| | Examples | | | | |
|---|---|---|---|---|---|
| | 6a | 6b | 7a | 7b | 8 |
| Bulk density [kg/m$^3$] | 755 | 827 | 772 | 880 | 896 |
| Particle porosity [%] | 11 | 3 | 15 | 7 | 2 |
| Moisture content [%] | 11.5 | 14.0 | 11.2 | 13.6 | 11.2 |
| Particle size [μm] | 390 | 873 | 423 | 547 | 488 |
| Temperature [°C.] | 50 | 50 | 50 | 50 | 50 |

By operating at a temperature of 50° C. it was made sure that the powder was in all cases in a deformable state in the second processing step. Consequently, the bulk densities of the powders were good in all cases. However, Examples 6*b* and 7*b* show that the best results were obtained when the powder was already deformable in the first step. After leaving the moderate speed granulator/densifier, the bulk density of the powder is very high. In order to obtain the final powder, a cooling and/or drying step was needed. The cooling was effecded by means of an airlift and the drying was carried out in an Anhydro (Trade Mark) fluid bed. The resulting properties of the powder after drying/cooling are given in Table 10.

TABLE 10

| | Examples | | | | |
|---|---|---|---|---|---|
| | 6a | 6b | 7a | 7b | 8 |
| Final processing step | drying | drying | cooling | drying | cooling |
| Bulk density [kg/m$^3$] | 742 | 835 | 772 | 885 | 906 |
| Dynamic flow rate [ml/s] | 121 | 126 | 111 | 82 | 76 |
| Particle porosity [%] | 14 | 4 | 15 | 7 | 2 |
| Moisture content [%] | 11.1 | 12.6 | 11.2 | 12.7 | 11.2 |
| Particle size [μm] | 410 | 849 | 436 | 462 | 449 |

Finally, the obtained powders were supplemented with TAED/perborate bleach particles, antifoam granules, and enzymes to formulate fabric washing powders which all had a good wash performance.

We claim:

1. Process for the continuous preparation of a granular detergent composition or component having a bulk density of at least 650 g/1, which comprises (i) in a first step mixing a particulate starting material in a high-speed mixer/densifier, the mean residence time being from about 5–30 seconds to obtain a powder;

(ii) in a second step mixing said powder in a moderate-speed granulator/densifier, said powder thereby being brought into, or maintained in, a deformable state said mixing of the powder in said deformable state reducing the intraparticle porosity of said powder the mean residence time being from about 1–10 minutes and;

(iii) in a final step drying and/or cooling said powder thereby obtaining a granular detergent composition or component.

2. Process according to claim 1, wherein the particulate starting material is already brought into, or maintained in, a deformable state in the first step.

3. Process according to claim 1, wherein the mean residence time in the second step is from about 2–5 minutes.

4. Process according to claim 1, wherein the deformable state is brought about by operating at temperatures above 45° C. and/or adding liquid to the particulate starting material.

5. Process according to claim 1, wherein nonionics and/or water are sprayed on to the particulate starting material in the first step.

6. Process according to claim 1, wherein the particulate starting material comprises a mixture of spray/-dried material and non spray dried material.

7. Process according to claim 6, wherein the particulate starting material is a spray-dried detergents base powder.

8. Process according to claim 1, wherein the particle porosity of the final granular detergent product is less than 10%.

* * * * *